United States Patent [19]

Gordon et al.

[11] 4,383,422

[45] May 17, 1983

[54] PORTABLE INSULATED HOLDER FOR BEVERAGE CONTAINERS

[76] Inventors: Jay E. Gordon, Rte. 5, Box 47A; Peter M. Wells, 213 Cedarcrest Dr., both of Brevard, N.C. 28712

[21] Appl. No.: 326,855

[22] Filed: Dec. 3, 1981

[51] Int. Cl.[3] ..... F25D 3/08

[52] U.S. Cl. ..... 62/457; 215/13 R; 220/231; 220/410

[58] Field of Search ..... 62/457, 430; 215/13 R; 220/231, 420, 425, 408, 410

[56] References Cited

U.S. PATENT DOCUMENTS

| | | | |
|---|---|---|---|
| 4,163,374 | 8/1979 | Moore et al. | 62/457 |
| 4,183,226 | 1/1980 | Moore | 62/457 |
| 4,218,967 | 8/1980 | Batchelor | 220/231 |
| 4,338,795 | 7/1982 | House, Jr. | 62/457 X |

*Primary Examiner*—Lloyd L. King
*Attorney, Agent, or Firm*—Luke J. Wilburn, Jr.; Wellington M. Manning, Jr.

[57] ABSTRACT

An insulated holder for beverage containers having walls defining a generally cup-shaped, open-topped compartment for receiving a chilled beverage container therein, the holder being dimensioned so that the side walls of the holder are spaced from the container side walls throughout the major portion of the height of the compartment, a flexible member sealingly engaging the side walls of the beverage container at the upper end of the compartment to form an airtight, sealed space within the compartment and provide effective insulation to the beverage container. The walls of the holder are formed of an inner air-impervious layer and an outer soft cushion layer of foam plastic insulating material. The lower portion of the holder may be provided with a refrigerant which engages the bottom of the beverage container in conductive heat transfer relation and is disposed in convective heat transfer relation with the sealed air space surrounding the side walls of the beverage container.

Valve means are provided in the holder wall to permit ready insertion and removal of a beverage container from the holder compartment.

13 Claims, 6 Drawing Figures

PORTABLE INSULATED HOLDER FOR BEVERAGE CONTAINERS

This invention relates to an improved portable insulated holder for beverages in containers, and, more particularly, to a handheld insulated holder for retarding the warming of beverages in containers during their consumption.

BACKGROUND OF THE INVENTION

Various insulated beverage container holders for cooling or retarding the warming of potable liquids during their consumption are known. The following U.S. Pat. Nos. are illustrative of certain of such container holder constructions.

1,771,186
2,039,736
2,926,508
3,089,317
3,161,031
3,205,677
3,205,678
3,302,427
3,302,428
3,766,975
3,807,194
3,995,445
4,037,428
4,163,374
4,183,226
4,255,944
Re 26,724

In particular, U.S. Pat. Nos. 4,163,374 and 4,183,226 disclose insulated beverage holders for canned or bottled drinks comprising an outer insulated cup containing an inner liner between which is located a freezeable liquid which surrounds the side walls and bottom of a compartment for receiving the beverage container. Such patents also disclose the use of a circular plastic ring with inwardly disposed flanged fingers, which are deformed downwardly during insertion of the beverage can to frictionally engage and hold the same.

U.S. Pat. Nos. 3,302,427 and 3,302,428 disclose relatively expensively constructed beverage can holders comprising a double wall container having sealed between its walls a liquid which may be frozen in the freezer compartment and employed to maintain a canned drink cool by contact with the walls of the can to achieve heat transfer between the same.

U.S. Pat. Nos. 4,037,428 and 4,255,944 disclose cooler assemblies for receiving wine bottles or other glass type beverage containers, and having a coolant material, such as ice or the like, in its lower base portion for chilling or maintaining a beverage in a container cool during its consumption.

It is also known to provide an insulated holder for chilled or cooled canned beverages which is made of relatively rigid styrofoam and is provided with an upper flange or ring to grippingly receive a cool canned drink therein and insulate the same during consumption of the beverage therein.

In use of insulated beverage container holders in recreational activities, such as while golfing, fishing, swimming, or observing or participating in other sport events, it is a typical practice to place a prechilled canned or bottled beverage in the insulated holder for its consumption by the individual. The purpose of the beverage container holder is to maintain the cooled or chilled beverage in a cold or chilled condition for a longer period of time, i.e., retard its warming, than would otherwise be the case if the beverage container were exposed directly to the surrounding environment. The retention of the cooled or chilled condition of the beverage for a longer period of time is desirable, particularly where the beverage may not be palatable when warm, or may be drunk slowly, as when the beverage is consumed during the course of participation in activities, such as swimming, fishing, playing a round of golf, or the like.

In insulated beverage container holders which employ a freezeable liquid, such as the aqueous methyl cellulose, glycerines, and glycol-type compositions, hereinafter referred to as a refrigerant, the liquid refrigerant is frozen in the freezer compartment of a refrigerator, and subsequently used to keep the beverage cooler for a longer period of time than do those insulated holders containing no refrigerant.

In uses involving outside recreational activities of extended duration, it can be appreciated that it is desirable that a beverage container holder provide insulation and retard warming of the beverage as long as possible during its use, even when a refrigerant material therein begins to reach ambient temperature. It is further highly desirable that such beverage container holders be resistant to breakage under rough handling and use, as well as be economical, lightweight and compact in construction. It is also desirable that such holders be stable against tilting or spilling of the beverage during its consumption, particularly when they may be placed on uneven or unsteady surfaces for support, such as in boats, golf carts, and the like.

BRIEF OBJECTS OF THE INVENTION

It is therefore an object of the present invention to provide an improved portable insulated holder for beverage containers which is particularly adapted for maintaining the beverage in the containers at a reduced temperature for extended periods of time during its consumption.

It is another object to provide an improved portable insulated holder for a beverage container which is of economical and lightweight construction, highly resistant to breakage by external force and pressure, and is readily stable and usable in outside environments, particularly during recreactional activities.

It is a more specific object to provide an improved beverage container holder for maintaining chilled or cooled beverages in such condition for longer periods of time during their consumption, and which is particularly adapted to receive various standard sized beverage containers, including cans, bottles and the like.

It is a further object to provide an improved insulated holder for beverage containers which includes a refrigeratable substance which may be frozen or chilled to provide a positive cooling effect to the beverage containers, and which may be employed for longer periods of time to maintain cooled or chilled beverages colder, than those constructions believed available in the prior art.

It is a still further object to provide an insulated holder having refrigerant therein which can effectively retard warming of a chilled beverage even when the refrigerant reaches ambient temperatures.

BRIEF DESCRIPTION OF THE DRAWINGS

The above as well as other objects of the present invention will become more apparent, and the invention will be better understood from the following detailed description of preferred embodiments thereof, when taken together with the accompanying drawings, in which.

DETAILED DESCRIPTION OF PREFERRED EMBODIMENTS

Figure 1:
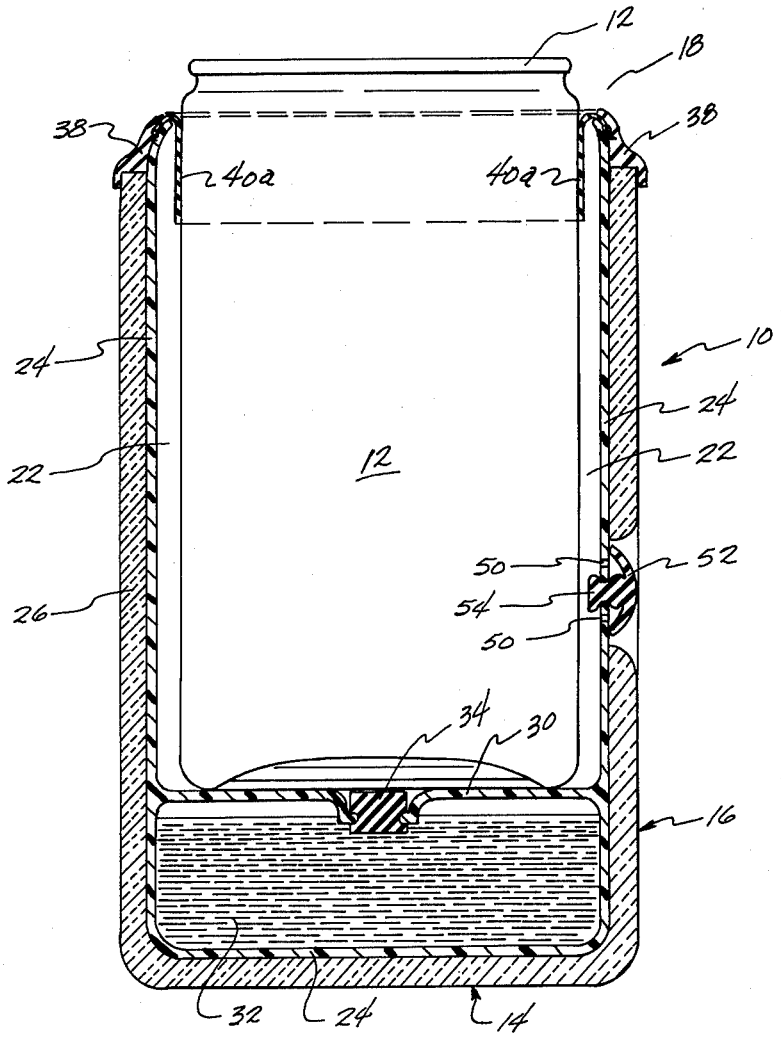
FIG. 1 is a cross-sectional elevation view of an improved portable insulated beverage container holder of the present invention showing the disposition of a typical beverage can therein during use.

Referring more specifically to the drawings, FIG. 1 shows a preferred form of the invention which comprises an insulated holder 10 shown generally in sectional elevation, with a beverage container or can 12 disposed therein. The holder 10 is of generally cylindrical configuration and includes a bottom wall 14, circular upstanding side wall or walls 16, and an open top 18 defining a generally cylindrical cup-shaped compartment 20 for receiving the beverage can. As seen in FIG. 1, the side walls 16 forming the compartment 20 are sufficiently spaced, in transverse direction, to ensure that the compartment side walls are spaced from the side walls of the container 12 to create an annular air space 22 therebetween throughout the major portion of the height of the compartment.

The holder walls are formed of an inner layer 24 of air impervious plastic of relatively thin wall construction, such as a shape-molded polyethylene, polystyrene or the like, which is generally shape-sustaining, but may be resiliently deformed by external pressure without fracture. Attached to inner layer 24 of the walls is an outer insulating layer 26 of generally soft cushion material, such as a polyurethane or polystyrene foam sheet material. The foam layer 26 is secured to the air impervious plastic inner layer 24 by suitable means, such as a conventional adhesive.

Preferably, the holder 10 is provided with internal wall means, shown in FIG. 1 as a transverse wall portion 30 extending between the inner side wall layers 24 of the holder and sealingly secured thereto to form a sub-compartment in the lower portion of the holder compartment below the beverage container 12 for the retention of a suitable liquid refrigerant 32, such as a high viscosity aqueous solution of methyl cellulose, glycerine, or glycol-type gelatinous freezeable substance. Such refrigerant materials are well known in the prior art, and have long been employed to cool various materials in portable containers when frozen in a freezer compartment of a refrigerator. The refrigerant 32 fills the sub-compartment to a desired level to permit the expansion of the refrigerant during freezing without damage to the sub-compartment walls, and may be supplied to the sub-compartment through a central opening by removal of a filler cap or plug 34 in the transverse wall member 30.

Figure 2:
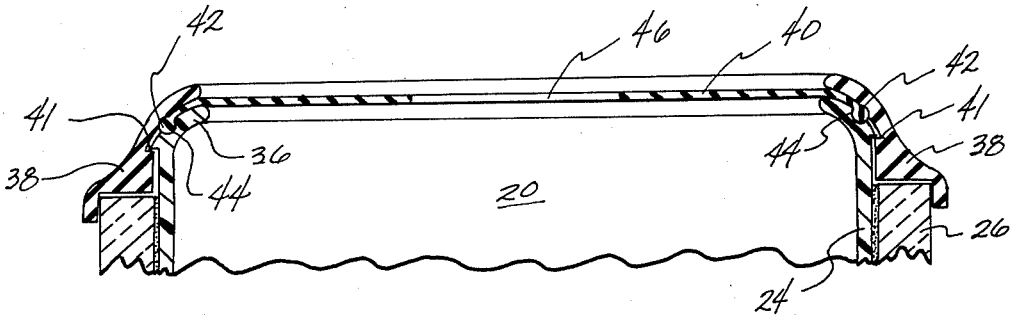
FIG. 2 is an enlarged broken-away sectional elevation view of the top portion of the beverage container holder of FIG. 1, with the can removed, and showing the disposition of a flexible elastic member for maintaining an air-tight seal of a beverage container in the holder.
Figure 6:
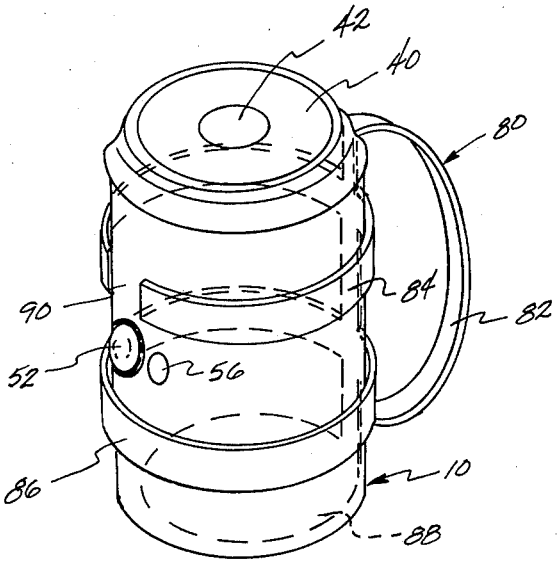
FIG. 6 is a perspective view of the holder of FIG. 1, showing a handle device which may be employed with the holder.

As seen in FIGS. 1 and 2, attached to an upper inwardly turned lip portion 36 of the side walls of the holder by an outer plastic ring member 38 is an air-impervious elastic membrane, such as a rubber sheet 40. Sheet 40 has a peripheral bead portion 42 which resides in a peripheral groove 44 (FIG. 2) in the side wall inner layer 24 and ring member 38 is secured in snap-fit relation with the side wall lip portion 36 at 41. Ring member 38 thus maintains the sheet 40 in airtight attachment to the inner side walls 24 of the holder. The flexible rubber sheet 40, as best seen in FIGS. 1, 2 and 6, is stretched taut across the top of the holder compartment and has a central small diameter opening 46 (FIGS. 2 and 6) which stretches to form a larger diameter opening (FIG. 1) when a beverage container is inserted into the holder compartment. Other means may be provided for securing the peripheral portion of the elastomeric sheet 40 in airtight attachment with the holder side walls, such as adhesive securement with a suitable high strength adhesive material.

As seen in FIG. 1, the elastomeric membrane or sheet 40 is displaced downwardly so that a portion **40*a* engages and lies along an upper wall portion of the beverage container to form an airtight sealed annular space 22 between the inner side walls 24 of the holder compartment and the side walls of the beverage container 12 therein. Since the inner side walls 24 of holder 10 are spaced from the side walls of the beverage container 12 throughout the height of the compartment, the side walls of the beverage container are effectively insulated both by the insulating foam layer 26 and the sealed air space 22** between the side walls of the beverage container and the inner wall surfaces of the holder.

At least portions of the bottom wall of the beverage container 12, depending upon the particular shape thereof, reside in direct contact with the transverse lower wall 30 forming the upper wall of the sub-compartment containing the refrigerant 32 to provide direct cooling effect, or heat transfer by conduction, between the container bottom wall and the sub-compartment containing the refrigerant. Refrigerant 32 in the sub-compartment also provides a convective cooling effect to the sealed air space 22 along the side walls of the holder compartment.

To obtain a positive airtight seal in the holder compartment 20 while permitting a beverage container to be inserted into and removed therefrom, the side wall of the holder is provided with valve means, shown as one or more openings, such as small uniformly spaced air vent holes 50 therethrough, over which resides a resiliently deformable rubber or plastic valve element 52. Valve element 52 is positionally inserted into wall 16, through an opening in insulation 26, and secured to the holder inner side wall 24 by a deformable central extension member which extends through an opening in wall 24 and has an enlarged end portion 54. As seen, the valve element 52 normally resides over the vent holes 50 in sealing engagement with the outer surface of wall layer 24, and acts as a one way valve member, permitting air to be expressed by pressure from the holder compartment as a beverage container is inserted through the opening of the flexible membrane sheet 40, while precluding the reverse movement of air into the compartment from the outside of the holder.

Thus when a beverage container 12 is inserted into the holder compartment with its side walls in sealing engagement with the rubber membrane 40, the container cannot be withdrawn therefrom because of the partial vacuum effect produced when the container is attempted to be withdrawn. To remove the container 12 from the compartment, it is necessary, with the valve means as shown in FIGS. 1 and 6, to manually press against a side wall portion 56 (FIG. 6) of the holder immediately adjacent the vent valve 52 to deflect the surface of side wall inner layer 24 inwardly, allowing air to pass under the edge of the valve and through the vent openings 50 into the compartment as the container 12 is manually withdrawn.

Figure 3:
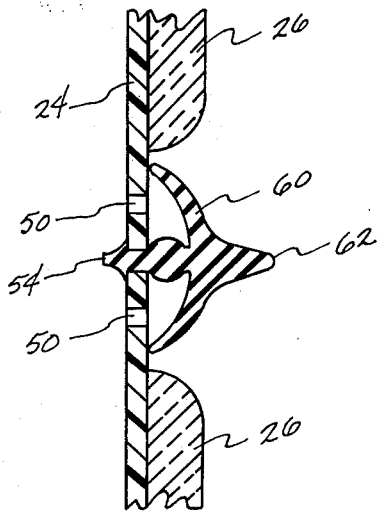
FIG. 3 is an enlarged broken-away sectional elevation view of a side wall portion of a holder of the present invention, illustrating a modified form of pressure release valve from that shown in FIG. 1, which valve permits insertion and removal of a beverage container from the holder.

FIG. 3 shows a somewhat modified form of valve means from that of FIG. 1 wherein a resiliently deformable plastic or rubber valve element 60 is similarly displaceable by air pressure in the holder compartment during beverage container insertion to release air from the compartment, but is provided with an outwardly extending tip 62 which may be manually deflected sideways by the finger to displace the edge of the valve from the surface of the side wall inner layer 24 and permit the passage of air through the vent openings 50 into the compartment during withdrawal of the beverage container.

Although not shown, if it desired to have the valve means of the present invention operate automatically without the need for mechanical deflection of the valve element or side wall to release the beverage container from the holder compartment, the valve means may take the form of two one-way valve elements identical to valve element 52 of FIG. 1, one of which would be mounted as shown in FIG. 1, and the other of which would be mounted to engage the inside wall surface of the inner layer 24 in spaced relation from the first element and to overlie an additional opening or openings through the wall, thus permitting automatic ingress of the air into the holder compartment as the beverage can is withdrawn therefrom.

Figure 4:
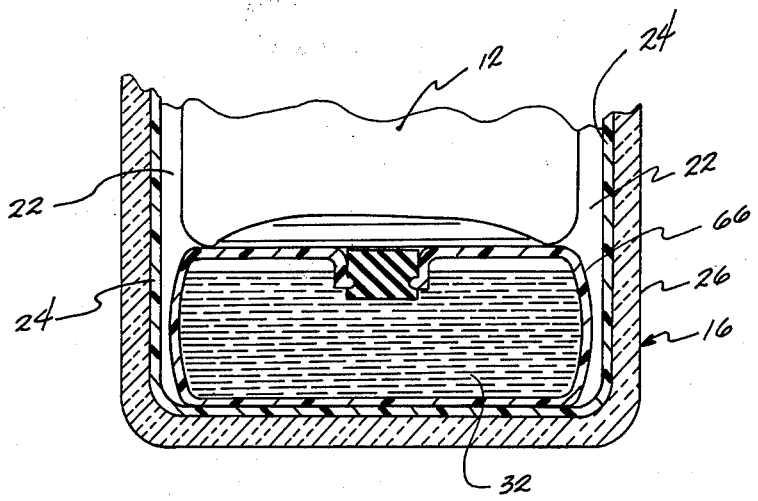
FIG. 4 is a broken-away sectional elevation view of a lower portion of a holder of the present invention, showing a modified form of compartment for containing a refrigerant material of the holder.

FIG. 4 shows a modified form of sub-compartment for a refrigerant material 32, which comprises internal wall means in the form of a cartridge 66 which can be removed from the holder 10 and separately placed in the freezer of a refrigerator for pre-chilling or freezing before use. After freezing, the sub-compartment cartridge 66 containing refrigerant is deposited into the bottom of the compartment of the holder to directly engage the bottom wall of the beverage container and impart a cooling effect thereto, while also providing additional cooling effect to the air space 22 by convection, as aforementioned.

Figure 5:
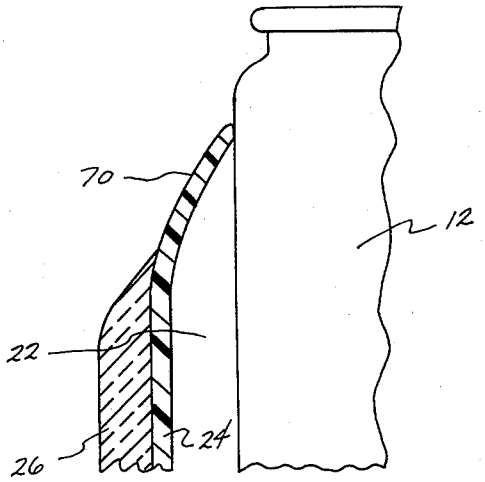
FIG. 5 is an enlarged broken-away sectional elevation view of an upper side wall portion of a holder of the present invention, showing a modified form of sealing means for maintaining air tight seal of the beverage container in the holder.

FIG. 5 shows a modified form of means for sealing the upper opening of the holder compartment wherein the means for engaging the side walls of the beverage container 12 comprises an inwardly curved extension 70 of the inner plastic wall layer 24 of the side walls 16 which tapers inwardly and upwardly to resiliently engage the walls of the beverage container, as shown.

FIG. 6 is a perspective view of the holder of FIG. 1, showing a handle member 80 which may be formed of relatively rigid plastic and serves to support the holder 10 from the hand, if desired. As seen, the handle member 80 comprises a hand-engageable portion 82 with holder-encircling bands 84, 86 and a circular base plate 88. The holder 10 may be slidingly received within the rings 84, 86 and upper ring 84 may be split, as at 90, to permit passage of the air vent valve element 52 to a position between the two rings.

From the foregoing description of preferred embodiments of the invention, it can be seen that the beverage container holder construction of the present invention provides effective insulation for a beverage container both by means of the outer foam plastic layer 26 and by the sealed air space 22 between the side walls of the holder and the side walls of the beverage container. In addition, pre-cooled or chilled beverage containers may be maintained in a cool condition for extended periods of time by means of the frozen refrigerant which imparts a cooling effect directly by conductive heat transfer through the bottom wall of the beverage container, as well as by convective heat transfer from the sealed air space surrounding the side walls of the beverage container.

When the insulated holder of the present invention is used for extend periods without refreezing of the refrigerant, such as during day long outside recreational activities, it can be appreciated that the refrigerant will gain heat and eventually reach ambient temperature. In such situations, a pre-chilled or cooled beverage in its container can still be maintained in cooled condition for extended periods, due to the fact that it is maintained in heat insulated relationship by the foam layer 26 and the sealed air space 22 in the holder. In distinction thereto, it can be appreciated that prior art holders having an ambient temperature liquid refrigerant in contact with both bottom and side walls of a beverage container will not maintain a chilled beverage as cool as the construction of the present invention, since the warmer, ambient temperature refrigerant in conductive heat transfer relation with both bottom and side walls of the chilled beverage container will produce a greater warming effect on the beverage in the container than the sealed air space of the present invention.

Restricted location and isolation of the relatively heavy refrigerant material to the bottom of the beverage container holder, as herein described, also provides a base-loaded weight distribution to the holder, making it highly resistant to tilting or tipping over during use, with consequence spilling of the beverage therein.

As can be appreciated, the beverage container holder of the present invention should be of a size to ensure that the side walls of the holder are always spaced from the outer side walls of most conventional size single drink bottles and cans to provide the airtight space for insulation purposes described. Typically, the larger of the standard size can beverage and bottled beverage containers, of the 6 to 16 ounce capacity, are about 2.5 inches in diameter. In such cases, the internal diameter of the holder compartment may be about 3 inches to provide a lateral air space of approximately 0.25 inch between the side walls of the holder and the side walls of the container. Typically, the foam insulation layer 26 may be approximately 0.25 inch in thickness, while the air impervious plastic inner layer 24 may be of about 0.05 inches in thickness. The height of the holder compartment above the inner transverse wall member 30 or refrigerant cartridge 66 may be about 4.5 inches to accommodate the heights of most canned and bottle beverages in the sizes mentioned. The diameter of the circular opening in the rubber membrane 40 may be approximately one inch, prior to insertion of the beverage container, to provide effective airtight seal of the container in the compartment and even sealingly accommodate cans or bottles which may vary in transverse cross-sectional dimension along their length, e.g., bottles with tapering neck portions.

That which is claimed is:

1. An insulated holder for beverage containers having walls defining a generally cup-shaped, open-topped compartment for receiving a beverage container therein, with the side walls of the compartment spaced from the side walls of the beverage container throughout the major portion of the height of the compartment, said holder walls comprising an air-impervious, generally shape-sustaining inner layer defining interior wall surfaces of the holder, and an outer insulating layer of generally soft flexible foam type material secured thereto, and air-impervious means extending inwardly from the upper portion of the side walls of the holder to engage side walls of a beverage container placed in the holder compartment and form a generally airtight, sealed space in the holder compartment between the side walls of the holder and the beverage container.

2. An insulated holder as defined in claim 1 wherein said outer layer is a plastic foam, and said holder side walls are generally flexible to permit deformation under pressure without fracture.

3. A holder as defined in claim 1 including internal wall means in a lower portion of the holder defining a sealed sub-compartment below a beverage container received in the compartment, and a refrigerant material in said sub-compartment to impart a cooling effect to a beverage container in the holder compartment by conductive heat transfer through the bottom wall surfaces of the container and by convective heat transfer through the airtight sealed space between the side walls of the holder and the container.

4. An insulated holder as defined in claim 3 wherein said internal wall means includes means restricting the location of said refrigerant in said sub-compartment to a position below the bottom of a beverage container placed in said holder compartment.

5. A holder as defined in claim 3 wherein said internal wall means comprises wall members defining a sealed sub-compartment which is removable from said holder compartment and is receivable into the lower portion of the holder compartment for engagement with the bottom of a beverage container placed in the holder.

6. An insulated holder as defined in claim 2 wherein said inner layer is a plastic sheet material of relatively thin wall construction to which said plastic foam layer is secured.

7. A holder as defined in claim 1 wherein said air-impervious means for engaging the side walls of a beverage container comprises a thin elastomeric material attached to and extending inwardly from an upper inwardly turned lip portion of the side walls of the holder and defining an opening which is substantially smaller in dimension than the transverse dimension of a beverage container to be received therein, whereby the elastomeric material sealingly engages the side walls of the beverage container in airtight relation therewith.

8. A holder as defined in claim 7 including valve means in a wall of said holder for permitting air to leave said airtight space during insertion of a beverage container into the holder compartment and, upon either automatic or manual displacement, for permitting air to enter said airtight space during removal of a beverage container from the holder compartment.

9. A holder as defined in claim 8 wherein said valve means comprises one or more openings through a side wall portion of said holder into said compartment, a flexible valve element attached to said side wall in overlying relation to said openings to normally permit the exit of air under pressure from said compartment through said openings and prevent the entrance of air into the compartment therethrough, and said flexible valve element being manually displacable to permit the passage of air into said compartment through said openings during beverage container removal.

10. A holder as defined in claim 1 wherein said means extending inwardly from the upper portion of the side walls of the holder to form said compartment opening comprises an elastomeric, thin membrane extending generally horizontally inwardly therefrom to form a small opening in the top of the holder, said membrane having a peripheral bead, said upper portion of the side walls of the holder having a corresponding peripheral groove, said membrane bead being disposed in said groove, and a ring member overlying said peripheral bead and groove in said upper side wall portion to secure said membrane in airtight, taut relation to said side wall, said membrane being elastically deformable by introduction of the beverage container into the compartment to enlarge said opening and to have a portion thereof disposed along the side walls of the beverager container to sealingly engage the same.

11. A holder as defined in claim 10 wherein said ring member is secured to the upper side wall of the holder in snap-fit relation therewith.

12. A holder as defined in claim 1 wherein said means extending inwardly from the upper portion of the side walls of the holder comprises an extension of said air impervious inner layer which tapers inwardly and upwardly to engage the side walls of the beverage container received in the holder.

13. A holder as defined in claim 1 wherein said holder includes handle means serving to support the same.

* * * * *

UNITED STATES PATENT AND TRADEMARK OFFICE

CERTIFICATE OF CORRECTION

PATENT NO. : 4,383,422
DATED : May 17, 1983
INVENTOR(S) : Jay E. Gordon and Peter M. Wells It is certified that error appears in the above-identified patent and that said Letters Patent are hereby corrected as shown below:

Column 5, line 39, after "it", please insert--is--.

Column 6, line 30, "extend" should read --extended--.

Column 6, line 54, "consequence" should read--consequent--.

Column 8, claim 8, line 46, "beverager" should read--beverage--.

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*